United States Patent [19]

Kelaita, Jr. et al.

[11] Patent Number: 4,801,907

[45] Date of Patent: Jan. 31, 1989

[54] UNDERVOLTAGE RELEASE ACCESSORY FOR A CIRCUIT BREAKER INTERIOR

[75] Inventors: Joseph B. Kelaita, Jr., Bristol; Edwin J. Collin, Southington, both of Conn.

[73] Assignee: General Electric Company, New York, N.Y.

[21] Appl. No.: 169,545

[22] Filed: Mar. 17, 1988

[51] Int. Cl.[4] ..... H01H 83/12; H01H 73/00; H01H 75/02

[52] U.S. Cl. ..... 335/20; 335/14; 335/166

[58] Field of Search ..... 335/20, 14, 174, 175, 335/164, 166

[56] References Cited

U.S. PATENT DOCUMENTS 3,761,776 9/1973 Willard .
3,761,777 9/1973 Willard .
3,761,778 9/1973 Willard .
4,301,434 11/1981 Castonguay ..... 335/20
4,467,299 8/1984 Collin et al. ..... 335/20

*Primary Examiner*—H. Broome
*Attorney, Agent, or Firm*—Richard A. Menelly; Walter C. Bernkopf; Fred Jacob

[57] ABSTRACT

An undervoltage release accessory is attached to the interior of a circuit breaker enclosure proximate the operating handle assembly. A reset mechanism positioned between the handle operator and the undervoltage release plunger resets the undervoltage release plunger after an undervoltage condition. A flexible reset spring on the reset mechanism compensates for mechanical tolerances between the reset mechanism and the undervoltage release plunger.

10 Claims, 2 Drawing Sheets

UNDERVOLTAGE RELEASE ACCESSORY FOR A CIRCUIT BREAKER INTERIOR

BACKGROUND OF THE INVENTION

An undervoltage release device is an accessory used with circuit protective apparatus to interrupt the circuit current when the systems voltage falls below a predetermined value. U.S. Pat. Nos. 4,301,434 and 4,467,299 describe such undervoltage release accessories and are incorporated herein for reference purposes.

Once the undervoltage condition has occurred and the undervoltage release has articulated the circuit breaker operating mechanism to interrupt the circuit current, it is essential that the systems voltage be restored before the circuit contacts are reclosed. When the undervoltage release condition is caused by a short circuit fault condition, the systems voltage is insufficient to energize the undervoltage release solenoid while the fault condition exists. When an attempt is made to close the circuit breaker contacts, there is a possibility that the circuit breaker contacts will close on a fault causing damage to the contacts, other circuit breaker components, and down-stream electrical apparatus. Accordingly, some means must be provided to insure that the undervoltage release solenoid is reset before the circuit breaker contacts are reclosed.

The undervoltage release arrangement of the instant invention prevents the circuit breaker operating mechanism from closing the circuit breaker contacts until and unless the undervoltage release solenoid is reset.

SUMMARY OF THE INVENTION

The invention comprises an undervoltage release device including a solenoid-driven plunger arranged for articulating a circuit breaker operating mechanism to open the circuit breaker contacts upon the occurrence of an undervoltage condition. A reset mechanism is interposed between the circuit breaker operating handle and the undervoltage release solenoid for moving the solenoid into a reset condition prior to driving the circuit breaker operating springs to their overcenter position to reclose the circuit breaker contacts. An undervoltage reset spring attached to one end of the reset mechanism provides lost motion between the reset mechanism and the undervoltage release plunger when the plunger becomes bottomed against the solenoid enclosure.

DESCRIPTION OF THE PREFERRED EMBODIMENT

Figure 1:
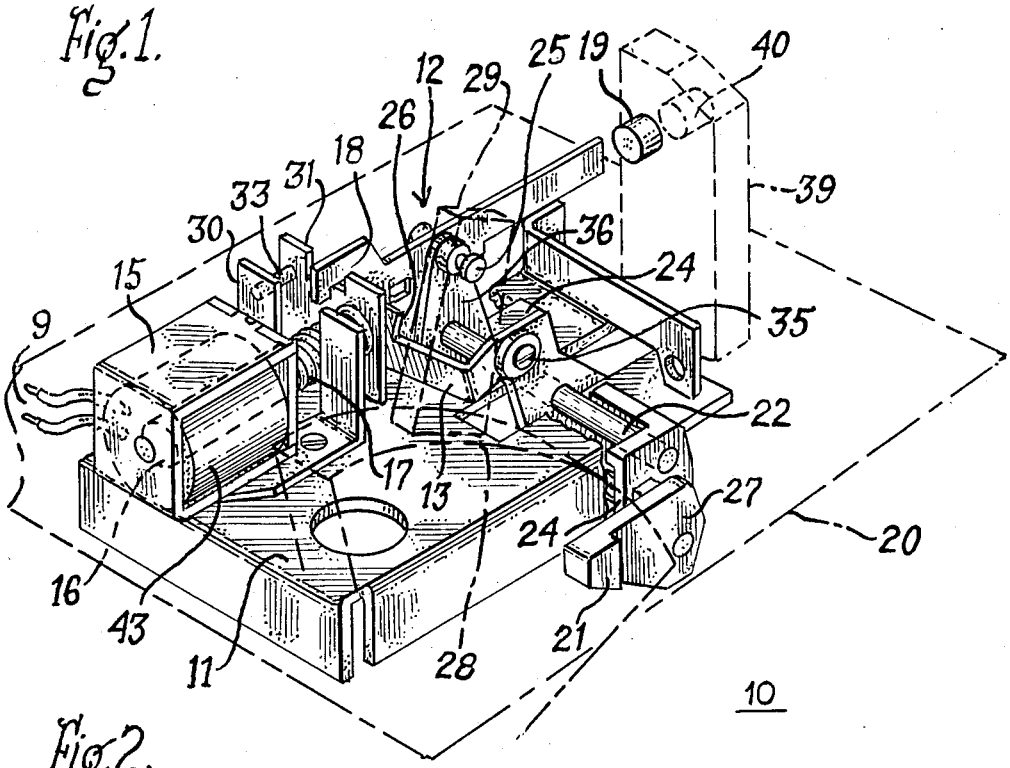
FIG. 1 is a top perspective view of the undervoltage release device of the invention arranged within a circuit breaker interior.

The undervoltage release device 10 is shown in FIG. 1 within a circuit breaker enclosure 20 depicted in phantom. The circuit breaker components are not shown but are described within U.S. Pat Nos. 3,761,776, 3,761,777 and 3,761,778 which patents are incorporated herein for purposes of reference. The undervoltage release device is supported on a platform 11 mounted within the circuit breaker enclosure next to the circuit breaker operating handle post 29 and skirt 28 for interacting with the undervoltage reset mechanism 12. The undervoltage release device includes an undervoltage release coil 15 within a housing 43 with a plunger 16 biased toward a forward "TRIPPED" position by means of an undervoltage release spring 17. A plate 31 is attached to one end of the plunger and is adjusted against a stop 30 upstanding from the platform 11 by means of an adjusting screw 33 when the plunger is in its reset position as shown. A trip actuator rod 18 extends from the plate 31 next to a circuit breaker trip button 19 which in turn abuts the circuit breaker trip bar 40 within the circuit breaker trip device 39 which is part of the circuit breaker assembly.

A pair of wire conductors 9 extend from the undervoltage release coil 15 for connection with an external circuit. A trip lever 36 which is attached to the trip actuator 18 by means of rivet 25 also connects with a reset lever 24 by means of a connecting rod 22 and to an operating lever 27. Operating lever 27 includes a tab 21 which extends therefrom for interacting with the circuit breaker handle skirt 28 in a manner to be discussed below. The reset lever 24 interfaces with the plunger 16 through an angled reset spring 13 which is fixedly attached to the reset lever 24 by means of rivet 5. Upon the occasion of an undervoltage condition whereby the voltage applied to the undervoltage release coil conductors 9 is insufficient to hold the plunger 16 against the forward bias exerted by the undervoltage spring 17, the trip actuator rod 18 is driven into contact with the trip button 19 displacing the trip bar 40 within the circuit breaker trip device 39 as shown in FIG. 2 causing the circuit breaker operating mechanism to become articulated and to interrupt the circuit current.

Figure 2:
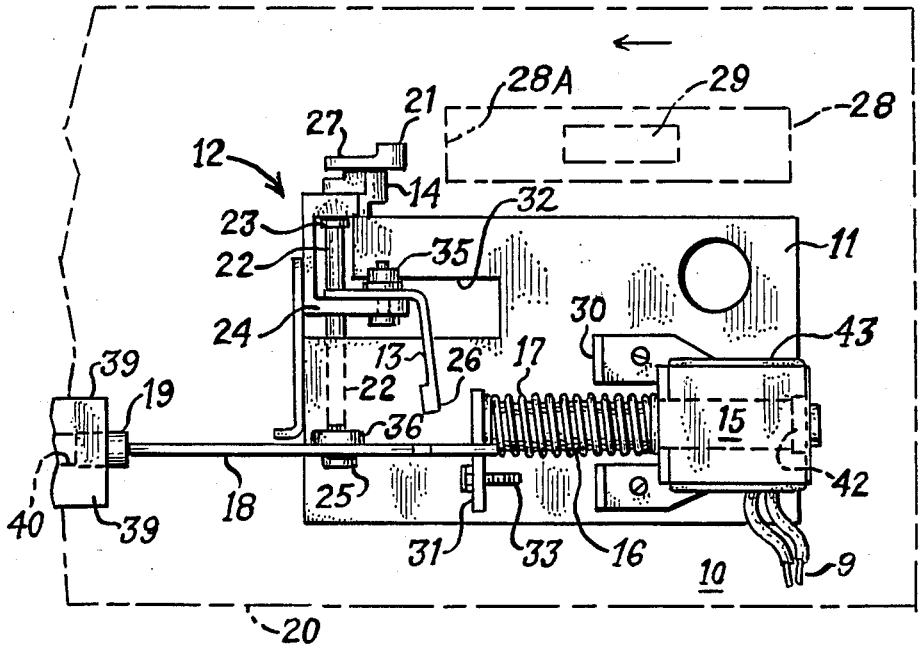
FIG. 2 is a plan view of the circuit breaker interior and undervoltage release device of FIG. 1 with the undervoltage release solenoid in a tripped condition.

It is noted in FIG. 2 that the reset mechanism 12 which interfaces with the plunger 16 by means of the angled reset spring 13 at one end thereof and with the circuit breaker operating handle skirt 28 by means of the bell crank 14 and operating lever 27 at an opposite end thereof is free from interacting with the plunger 16 during the tripping operation. The reset mechanism 12 later interacts with the handle skirt 28 and the plunger 16 in the following manner to reclose the circuit breaker contacts (not shown). The circuit breaker handle post 29 is moved forward in the indicated direction bringing the front edge 28A of the handle skirt 28 into contact with a tab 21 formed on the operating lever 27 located at one end of the bell crank lever 14. The bell crank lever 14 then rotates in a downward counterclockwise direction moving the reset lever 24 in the same direction and bringing the angled reset spring 13 into contact with the plunger 16 by contacting the arcuate reset spring tab 26 at the end of the reset spring with the plate 31 attached to the end of the plunger 16. The reset spring is arranged to have a maximum stiffness or resistance to flex, at the instant of contact between the arcuate reset spring tab 26 and plate 31 in order to drive the plunger back within the undervoltage coil 15. The connecting rod 22, extends from the bell crank lever 14 through the side of the platform 11 through a collar 23 and through the reset lever 24 terminating at the trip lever 36. When the reset lever 24 is fully rotated in the counterclockwise direction within the L-shaped slot 32 formed in the undervoltage release platform 11, the angled reset spring 13 is designed to exhibit a minimum stiffness and hence becomes flexed when the plunger 16 bottoms against the base 42 of the undervoltage release coil enclosure 43 and the adjusting screw 33 abuts against the stop 30. The maximum stiffness is provided to the reset spring by directing the reset spring force through the line of action of the spring such that the effective resistance to flex is high. When the reset lever 24 rotates in the downward clockwise direction the arcuate reset spring tab moves the reset spring below its line of action to thereby rapidly decrease the reset spring force against the plunger 16 and hence increase the spring flex as the plunger approaches the base 42 of the undervoltage coil enclosure 43. The spring flex at this time takes up the lost motion of the entire reset mechanism 12 by substantially reducing the spring force applied to the plunger. The reduction in spring force thereby allows for differences in mechanical tolerances between the components of the reset mechanism and the plunger, which can be considerable.

Figure 3:
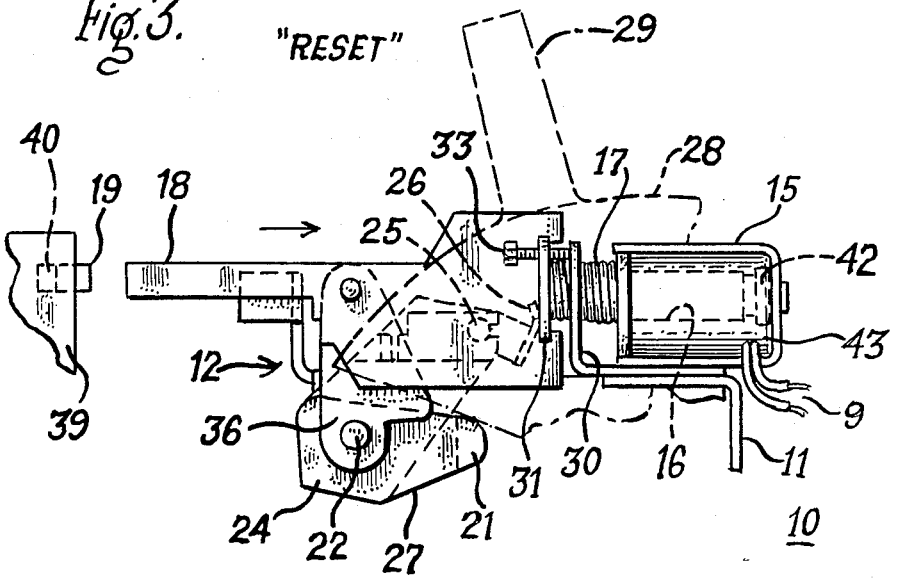
FIG. 3 is a side view of the undervoltage release device and circuit breaker interior of FIG. 1 with the undervoltage release solenoid in a reset condition.
Figure 4:
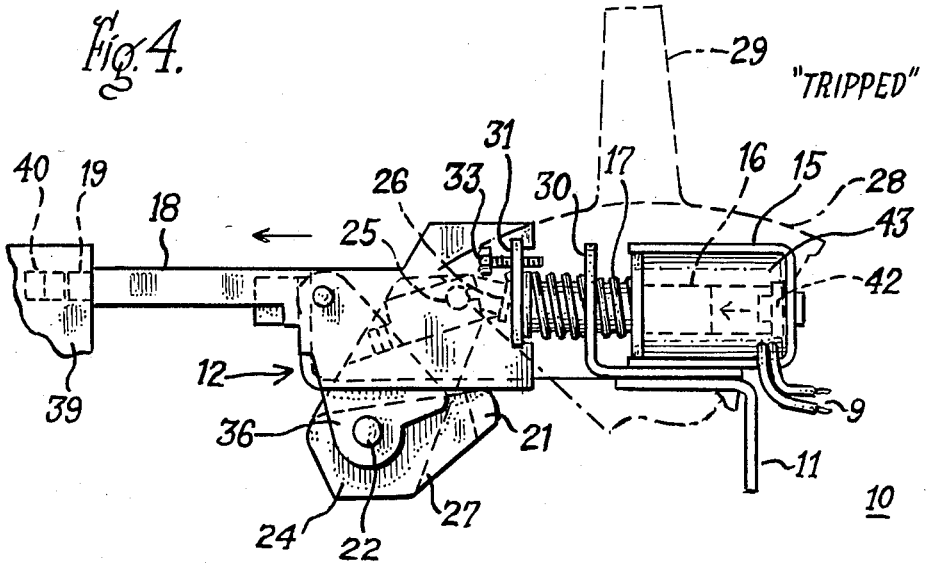
FIG. 4 is a side view of the undervoltage release device and circuit breaker interior of FIG. 1 in a tripped condition.

The undervoltage release device 10 is depicted in its completely "RESET" condition in FIG. 3 with the plunger 16 at its maximum distance within the undervoltage release coil 15 and bottomed against the base 42 of the undervoltage release coil enclosure 43. The side view of the undervoltage release device 10 shown in FIG. 4 is positionally reversed from that shown earlier in FIG. 2 to more clearly depict the reset mechanism components. The adjusting screw 33 is in contact with plate 31, the operating lever 27 is fully rotated in its counterclockwise direction as viewed in FIG. 2 and the operating handle post 29 is in its fully reset position. In the reset position, the trip actuator rod 18 is away from the trip button 19 such that the trip bar 40 within the trip mechanism enclosure 39 is at its non-tripped location.

Once the undervoltage release device is in the "RESET" position shown in FIG. 3 it immediately moves to the "TRIPPED" condition depicted in FIG. 4 when the systems voltage applied to the undervoltage release coil conductors 9 is less than the predetermined holding voltage for the undervoltage coil 15 such that the undervoltage spring 17 has driven the plunger 16 in the forward direction carrying the plate 31 and trip actuator rod 18 in the forward direction. The tip of the trip actuator rod 18 contacts and depresses the trip button 19 into contact with the trip bar 40 within the trip mechanism 39 causing the circuit breaker operating mechanism to become articulated and the circuit breaker contacts to become separated. In the tripped position, the handle operator post 29 is slightly to the right of its center position as indicated in phantom and the handle skirt 28 abuts the tab 21 on the operating lever 27. The reset mechanism 12 is operated on by movement of the handle operator post 29 in the counterclockwise direction to return the undervoltage release plunger 16 back to the reset position shown earlier in FIG. 3.

It has thus been shown that an undervoltage release mechanism can be reset without fear of closing the circuit breaker contacts while the circuit breaker contacts are energized. Manufacturing tolerances are corrected by the flexible interaction provided between the circuit breaker operating handle and the undervoltage plunger by means of an angled reset spring.

Having thus described my invention, what I claim as new and desire to secure by Letters Patent is:

1. An undervoltage release mechanism for circuit breakers comprising in combination:

a support;

an electromagnetic coil on said support;

a plunger within said electromagnetic coil spring-biased for movement in a first direction by means of a charged compression spring when voltage applied to said coil drops to a predetermined level;

a reset mechanism on said support and arranged for moving said plunger in a second direction when said voltage returns to a value greater than said predetermined level, said reset mechanism comprising:

a bell crank lever mounted on said support intermediate said plunger and an operating lever, said bell crank being arranged for rotation in a predetermined direction;

a reset lever attached to said bell crank lever and arranged for rotation in a direction opposite from said predetermined direction; and a reset spring attached to said reset lever and arranged for contacting said plunger when said reset lever is first rotated to drive said plunger in said second direction against charged compression spring upon rotation of said operating lever in said predetermined direction.

2. The undervoltage release mechanism of claim 1 wherein said reset spring comprises an angled configuration.

3. The undervoltage release mechanism of claim 2 wherein said angled reset spring comprised a first end and a shorter second end, said second end being attached to said reset lever and said first end extending from said reset lever into abutment with said plunger.

4. The undervoltage release mechanism of claim 1 further including a trip lever attached to said reset lever and arranged for rotating in said opposite direction.

5. The undervoltage release mechanism of claim 4 including a trip actuator extending from said plunger and pivotally attached to said trip actuator whereby rotation of said trip lever in said opposite direction moves said trip lever in said opposite direction.

6. The undervoltage release mechanism of claim 1 including an operating lever attached to said bell crank lever and arranged proximate a circuit breaker operating handle whereby rotation of said operating handle drives a part of said operating handle into contact with said operating lever causing said operating lever to rotate in said predetermined direction.

7. The undervoltage release mechanism of claim 5 wherein said trip actuator is arranged proximate a circuit breaker trip button at one end whereby movement of said plunger in said first direction moves one end of said trip actuator into contact with said trip button and movement of said plunger in said opposite direction moves said trip actuator out of contact with said trip button.

8. The undervoltage release mechanism of claim 3 including an arcuate tab formed on said reset spring first end.

9. The undervoltage release mechanism of claim 2 wherein said angled reset spring defines a center of action, whereby said reset spring first contacts said plunger through said center of action, said angled reset spring exhibiting a maximum resistance to flex.

10. The undervoltage release mechanism of claim 9 wherein said coil is arranged within a housing, said plunger being stopped against a part of said housing, said angled reset spring thereafter contacting said plunger off said center of action to define a minimum resistance to flex.

* * * * *